United States Patent [19]

Karino

[11] 4,094,931

[45] June 13, 1978

[54] CARBURETOR ASSEMBLY

[75] Inventor: Kimiji Karino, Katsuta, Japan

[73] Assignee: Hitachi, Ltd., Japan

[21] Appl. No.: 744,399

[22] Filed: Nov. 23, 1976

[30] Foreign Application Priority Data

Nov. 28, 1975 Japan ..... 50-141618

[51] Int. Cl.[2] ..... F02M 13/04

[52] U.S. Cl. ..... 261/23 B; 123/127; 261/39 D

[58] Field of Search ..... 123/75 B, 32 ST, 119 F, 123/127; 261/23 A, 39 B, 39 D, 23 B

[56] References Cited

U.S. PATENT DOCUMENTS

| | | | |
|---|---|---|---|
| 3,180,576 | 4/1965 | Herman | 123/119 F |
| 3,791,358 | 2/1974 | Masaki et al. | 123/119 F |
| 3,837,322 | 9/1974 | Shishido et al. | 123/75 B |
| 3,968,189 | 7/1976 | Bier | 261/DIG. 56 |
| 4,003,355 | 1/1977 | Kamezaki et al. | 123/127 |

*Primary Examiner*—Tim R. Miles

*Attorney, Agent, or Firm*—Craig & Antonelli

[57] ABSTRACT

After the engine is started and until its warming-up is completed, control of the degree of opening of an auxiliary carburetor for supplying an enriched fuel-air mixture to the engine is effected, independently of the degree of opening of the throttle valve of a main carburetor for supplying a dilute fuel-air mixture to the engine, by means of a diaphragm device which is adapted to produce a displacement in response to the pressure at the outlet of the main carburetor and a bimetal strip which is adapted to produce a displacement as the temperature of the engine-gradually rises.

12 Claims, 3 Drawing Figures

CARBURETOR ASSEMBLY

BACKGROUND OF THE INVENTION

This invention relates to carburetor assemblies for internal combustion engines each comprising a main carburetor for producing dilute fuel-air mixtures and an auxiliary carburetor for producing enriched fuel-air mixtures, and more particularly to a carburetor assembly of the type described which is provided with means for effecting control of the ratio of the volume of an enriched fuel-air mixture supplied to the engine from the auxiliary carburetor to the volume of a dilute fuel-air mixture supplied to the engine from the main carburetor or the so-called air ratio.

In order to avoid the problem of air pollution by noxious components of exhaust gases from internal combustion engines, the internal combustion engines of automotive vehicles are nowadays provided with a main combustion chamber, and an ignition chamber communicating with the main combustion chamber and having an ignition plug mounted therein. In such internal combustion engines, dilute fuel-air mixtures are supplied to the main combustion chamber and enriched fuel-air mixtures are supplied to the ignition chamber, and each enriched fuel-air mixture is ignited in the ignition chamber to produce a flame which advantageously ignites each dilute fuel-air mixture in the main combustion chamber so that the engine can operate smoothly by the combustion of dilute fuel air mixtures for the most part of the duration of its operation. Carburetor assemblies used with such internal combustion engines each comprises a main carburetor for supplying dilute fuel-air mixtures to the main combustion chamber, and an auxiliary carburetor for supplying enriched fuel-air mixtures to the ignition chamber.

In conventional carburetor assemblies, it has hitherto been customary to manually effect control of the throttle valve of the auxiliary carburetor at the time the engine is started, although the throttle valve of the auxiliary carburetor is coupled to the throttle valve of the main carburetor to operate conjointly therewith when the engine is in steady state operating condition. More specifically, during the period in which the engine is started, self-cranking is attained so that the engine can carry on its motion by its own power and warming-up of the engine is completed, it has been usual practice to manually control the degree of opening of the throttle valve of the auxiliary carburetor in such a manner that the ratio of the volume of an enriched fuel-air mixture supplied from the auxiliary carburetor to the volume of a dilute fuel-air mixture supplied from the main carburetor is higher during the aforesaid period than during the period of steady state operation of the engine. Some disadvantages are associated with this manual control system. When control is effected manually, changes in the ratio of the volume of an enriched mixture to the volume of a dilute mixture is discontinuous, with the result that the operating condition of the engine becomes unstable. This leads to an increase in the amounts of noxious components of exhaust gases from the engine.

SUMMARY OF THE INVENTION

An object of this invention is to provide a carburetor assembly for an internal combustion engine which is capable of automatically effecting control of the ratio of the volume of an enriched fuel-air mixture to the volume of a dilute fuel-air mixture of the air ratio at the time the engine is started.

Another object is to provide a carburetor assembly for an internal combustion engine wherein the degree of opening of the throttle valve of the auxiliary carburetor is controlled independently of the degree of opening of the throttle valve of the main carburetor from the time the engine is started until its warming-up is completed.

Still another object is to provide a carburetor assembly for an internal combustion engine wherein control of the degree of opening of the throttle valve of the auxiliary carburetor is effected rapidly when the engine is in self-cranking condition, and thereafter control thereof is effected slowly in accordance with a rise in the temperature of the engine until its warming-up is completed.

In the carburetor assembly according to the invention, control of the degree of opening of the throttle valve of the auxiliary carburetor is effected independently of the degree of opening of the throttle valve of the main carburetor from the time the engine is started until the time its warming-up is completed. That is, the degree of opening of the throttle valve of the auxiliary carburetor is kept at a predetermined level from the time the engine is started until the time the engine attains self-cranking condition; when the engine is in self-cranking condition the negative pressure at the outlet of the main carburetor for delivering fuel-air mixtures is detected so as to correct the degree of opening thereof in a manner to move the lever toward a closed portion; with the progress of the engine warming-up, the degree of opening thereof is continuously corrected in a manner to move the valve further toward the closed position until the degree of opening thereof reaches a level for steady state engine operating condition; and thereafter the throttle valve of the auxiliary carburetor opens and closes conjointly with the throttle valve of the main carburetor.

The throttle valve of the auxiliary carburetor is controlled as presently to be described. When the engine is in self-cranking condition, control of the throttle valve of the auxiliary carburetor is effected by transmitting, through lever means, a displacement of a vacuum motor adapted to be actuated by the negative pressure at the outlet of the main carburetor to the throttle valve of the auxiliary carburetor. Control of the degree of opening of the throttle valve of the auxiliary carburetor after the engine has attained self-cranking condition is effected, as its warming-up progresses, by transmitting to the throttle valve of the auxiliary carburetor, through the lever means a displacement of a thermal motor which is actuated by a rise in the temperature of engine cooling water which indicates the degree of warming-up of the engine.

DESCRIPTION OF THE PREFERRED EMBODIMENT

Figure 1:
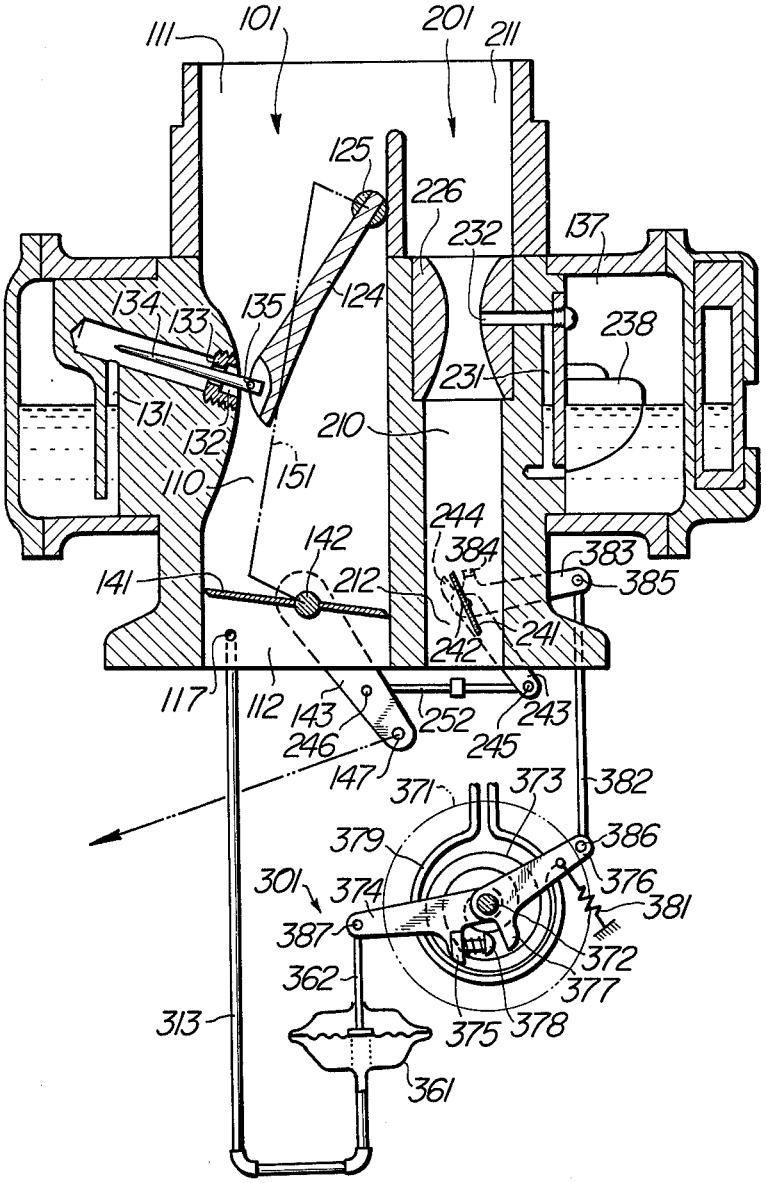
FIG. 1 is a schematic view of the carburetor assembly comprising one embodiment of this invention, showing in particular the mechanism for effecting control of the degree of opening of the throttle valve of the auxiliary carburetor.

The invention will now be described with reference to a preferred embodiment shown in the accompanying drawings. In FIG. 1, the carburetor assembly comprises a main carburetor 101 for supplying dilute fuel-air mixtures to the engine, an auxiliary carburetor 201 for supplying enriched fuel-air mixtures to the engine, and an auxiliary throttle valve controller 301 for effecting control of the degree of opening of a throttle vavle 241 of the auxiliary carburetor 201. The main carburetor 101 and the auxiliary carburetor 201 are arranged in parallel relationship in a body formed integrally by forging. The auxiliary throttle valve controller 301 is operatively connected to these carburetors.

A fuel bowl 137 from which fuel is supplied both to the main and auxiliary carburetors is provided at the outer periphery of the carburetors, and has a float 238 floating in the fuel for keeping constant the liquid level in the fuel bowl 137.

The main carburetor 101 will be first described in detail. A choke valve 124 is secured at one end thereof to a choke valve spindle 125 and disposed in a main inlet passage 111 which is the air intake side of the main air passage 110. The choke valve 124 is arranged in such a manner that the other end thereof is disposed in juxtaposed relation with a portion of the wall of the main inlet passage 111 which projects into the main inlet passage 111.

A main fuel passage 131 for communicating the main air passage 110 with the fuel bowl 137 opens at the projecting portion of the wall of the main air passage 110. The opening of the main fuel passage 131 formed at the projecting portion of the wall is disposed in a position such that the other end of the choke valve 124 is brought into contact with the opening when the choke valve spindle 125 moves in rotational motion.

A metering orifice 133 for metering fuel charges is threadably fitted into the opening in the projecting portion of the wall from the direction of the main air passage 110. A jet needle 134 of the needle shape which becomes increasingly smaller in diameter in going from the opening toward the interior of the main fuel passage 131 and extends through the metering orifice 133 is supported at one end thereof for movement into and out of the main fuel passage 131 by a pin 135 attached to the other end of the choke valve 124. By this arrangement, a main nozzle 132 is provided to the metering orifice 133 at the main air passage side thereof.

A main throttle valve 141 secured to a main throttle spindle 142 is disposed in a portion of the main air passage 110 which is disposed on the downstream side of the choke valve 124. The choke valve spindle 125 is connected to the main throttle spindle 142 through a linkage 151 which is disposed outside the main carburetor 101, so that the two spindles 125, 142 can be rotated conjointly with each other.

An accelerating lever 143 secured at one end thereof to the main throttle spindle 142 is disposed outside the main carburetor 101 and has attached to the other end thereof a pin 147 which is connected to an accelerator (not shown) in a manner that actuation of the accelerator is transmitted to the accelerating lever 143.

The auxiliary carburetor 201 is formed integrally with the main carburetor 101 and disposed in parallel relation therewith so that the stream of an enriched fuel-air mixture will flow parallel to the stream of a dilute fuel-air mixture.

A venturi 226 is provided at a side of an auxiliary inlet passage 211 which serves as an air intake port for an auxiliary air passage 210. The Venturi 226 has a throat which communicates with the fuel bowl 137 through an auxiliary fuel passage 231. An auxiliary nozzle 232 facing the auxiliary air passage 210 is provided to the end of the auxiliary fuel passage 231 which is disposed at the Venturi throat.

An auxiliary throttle valve 241 secured to an auxiliary throttle spindle 242 is disposed in a portion of the auxiliary air passage 210 which is disposed on the downstream side of the Venturi 226. Thus the auxiliary throttle valve 241 can open or close the auxiliary air passage 210 as the auxiliary passage spindle 242 rotates.

Disposed on the outside of the auxiliary carburetor 201 is an auxiliary throttle lever 243 which is pivotally supported at one end thereof by the auxiliary throttle spindle 242. A first projection 244 which serves as a stopper for restricting the degree of opening of the auxiliary throttle valve 241 is formed at one end of the auxiliary throttle lever 243 and disposed in a manner such that the first projection 244 extends in the longitudinal direction of the auxiliary throttle lever 243. The auxiliary throttle lever 243 has attached to the other end thereof a pin 245 which supports a second connecting rod 252 at one end thereof for connecting the auxiliary throttle lever 243 to the accelerating lever 143. The second connecting rod 252 is constructed such that its length is adjustable at the time the automotive vehicle is started so as to adjust the relative degree of openings of the main throttle valve 141 and the auxiliary throttle valve 241. The second connecting rod 252 is supported at the other end thereof by a pin 246 attached to the accelerating lever 143.

The auxiliary throttle valve controller 301 comprises a diaphragm mechanism and a bimetal mechanism. The detailed construction of these mechanisms will presently be described.

A bimetal housing 371 has mounted in its central portion a bimetal spindle 372 and encloses a first lever 374 and a second lever 376 pivotally supported by the bimetal spindle 372 and a bimetal strip 373 secured at one end to the bimetal spindle 372 and at the other end to the second lever 376 in such a manner that the bimetal strip 373 is wound spirally within the bimetal housing 371. The bimetal strip 373 is constructed such that a metal strip of a relatively higher coefficient of linear expansion is disposed at the outer side thereof and a metal strip of a relatively lower coefficient of linear expansion is disposed at the inner side thereof so that the bimetal strip 373 may move counter clockwise when it senses a rise in temperature.

A second projection 375 disposed in a portion of the first lever 374 which is near to the bimetal spindle 372 extends outwardly from the right side surface of the first lever 374 as seen in the direction of the bimetal spindle 372. An adjusting screw 378 comprising a spring-biased screw is mounted on a side of the second projection 375 which is near to the bimetal spindle 372.

A second projection 377 is formed in a portion of the second lever 476 which is near to the bimetal spindle 372, and projects outwardly from one side of the second lever 476 in such a manner that the projections 375 and 377 are disposed in spaced juxtaposed relation. The second and third projections 375 and 377 are constructed and arranged such that, when the first lever 374 moves counterclockwise in pivotal motion through an acute angle range, the adjusting screw 378 can be brought into contact with the third projection 377. Secured to an end of the first lever 374 which is opposite to the end thereof at which the first lever 374 is supported by the bimetal spindle 372 is a pin 387 which pivotally supports one end of a diaphragm rod 362 which is connected at the other end to a member of a diaphragm device 361 made of a suitable elastic material, such as rubber, metal foil, etc.

A side of the diaphragm device 361 which is opposite to the side thereof at which the diaphragm device 361 is connected to the first lever 374 maintains communication, through a vacuum pipe 313, with a vacuum port 117 opening in a main outlet passage 112 disposed on the downstream side of the main throttle valve 141.

A spring 381 urging the second lever 376 to move clockwise to return to its original position is mounted between the second lever 376 and a fixed part of the engine by securing the opposite ends thereof to these parts.

A pin 386 is attached to an end of the second lever 376 opposite to the end thereof at which the second lever 376 is supported by the bimetal spindle 372. A third lever 383 supported at one end thereof by the auxiliary throttle spindle 242 has a pin 385 attached to the other end thereof.

A first connecting rod 382 is pivotally supported at opposite ends thereof by the pins 385 and 386, so that the second lever 376 and the third lever 383 are coupled to each other through the first connecting rod 382 for conjointing operation.

Formed in a portion of the third lever 383 which is near to the auxiliary throttle spindle 242 is a fourth projection 384 which is disposed in a plane of pivotal movement of the third lever 383 and which extends outwardly from the fourth lever 383 at right angles to the longitudinal axis thereof. The third projection 384 is disposed such that, when the third lever 383 moves counterclockwise about the auxiliary throttle spindle 242, the third projection 384 is brought into contact with the first projection 244.

In the embodiment shown and described hereinabove, the first lever 374, the second lever 376, and the third lever 383 all move counterclockwise in pivotal motion from the time the engine is started until the time the engine warming-up is completed. By this pivotal movement of the three levers, the auxiliary throttle valve 241 continues its closing movement until the completion of engine warming-up, irrespective of the degree of opening of the main throttle valve 141. The auxiliary throttle valve 241 is adjusted beforehand by the auxiliary throttle valve controller 301 in such a manner that the degree of opening thereof is as shown in FIG. 1 when the engine is started.

Operation of the carburetor assembly according to the invention will be described from one operation stage to another.

(1) From the Time of Fuel Injection Until the Engine Attains Self-Cranking Condition When the engine is started, an enriched fuel-air mixture is supplied to an ignition (not shown) of the engine in order to increase the efficiency with which the engine is started. The degree of opening of the auxiliary throttle valve 241 is controlled beforehand by the auxiliary throttle valve controller 301 in such a manner that it is at a relatively high level when the engine is started.

(2) When the Engine Has Attained Self-Cranking Condition.

When the engine has attained self-cranking condition, the revolutions per minute of the engine is about 500 r.p.m. Since the engine has been set in motion, there is no need to maintain the ratio of the volume of an enriched fuel-air mixture to the volume of a dilute fuel-air mixture at a high level. If this high ratio continues during the time the engine is started, then this causes a loss of the fuel and results in an incomplete combustion of the fuel, thereby increasing the amounts of noxious components of the exhaust gases.

With an increase in the revolutions per minute of the engine, the degree of negative (subatmospheric) pressure in the main outlet passage 112 increases. The pressure in this portion of the main carburetor is transmitted through the vacuum pipe 313 to the diaphragm device 361 where a force sufficiently high to move the diaphragm rod 362 downwardly is exerted on the diaphragm.

Figure 2:
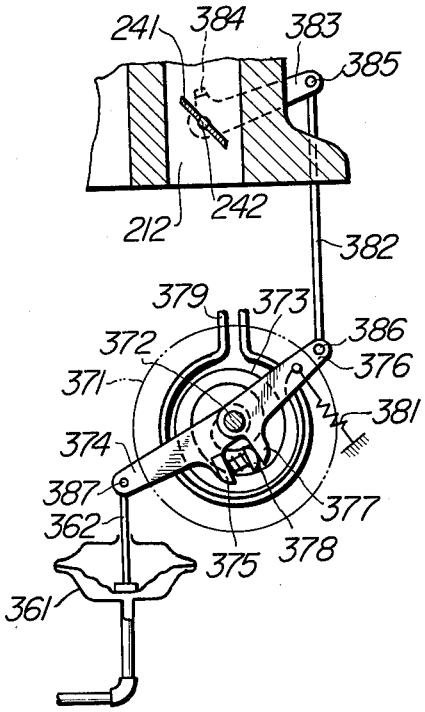
FIG. 2 is a fragmentary schematic view of the control mechanism, showing the manner in which the degree of opening of the throttle valve of the auxiliary carburetor is controlled in response to the negative pressure at the outlet of the main carburetor when the engine is in self-cranking condition.

Referring to FIG. 2, a displacement caused by the downward movement of the diaphragm rod 362 is transmitted to the first lever 374 and causes the same to move counterclockwise in pivotal motion about the bimetal spindle 372. This causes the adjusting screw 378 mounted on the first projection 375 of the first lever 374 to come into contact with the third projection 377 of the second lever 376 and to push the same, thereby causing the second lever 376 to move counterclockwise in pivotal motion about the bimetal spindle 372. The counterclockwise pivotal movement of the second lever 376 is transmitted through the first connecting rod 382 to the third lever 383 and causes the latter to move counterclockwise in pivotal motion about the auxiliary throttle valve spindle 242. Since the third lever 383 is supported by the auxiliary throttle spindle 242 and the auxiliary throttle valve 241 is also supported by the auxiliary throttle spindle 242. The auxiliary throttle valve 241 rapidly moves in a direction in which the auxiliary throttle valve 241 is closed, thereby extremely reducing the supply rate of an enriched fuel-air mixture supplied to the engine.

(3) When the Engine is in Warming up After the Engine has Attained Self-Cranking Condition.

Figure 3:
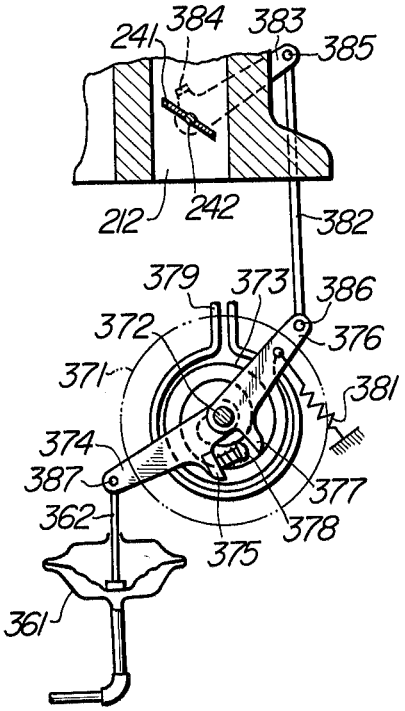
FIG. 3 is a fragmentary schematic view of the control mechanism, showing the manner in which the degree of opening of the throttle valve of the auxiliary carburetor is further controlled as the engine warming-up progresses, following the operation shown in FIG. 2.

Referring to FIG. 3, a heater 379 in which heated cooling water is circulated from an engine jacket (not shown) or a heating means (not shown) which generates heat as soon as an engine starter is actuated heats the bimetal strip 373 and causes the latter to expand. This causes a displacement of the bimetal strip 373 which is transmitted as a pivotal movement of the second lever 376, so that the second lever 376 gradually moves counterclockwise in pivotal motion about the bimetal spindle 372 over and above the range of angular displacement of the second lever 376 caused by the action of the adjusting screw 378 to move the second projection 377 and hence the second lever 376 counterclockwise. Thus the auxiliary throttle valve 241 continues to move slowly to its closed position.

It is set beforehand that the pivotal movement of the auxiliary throttle valve 241 terminates when the third projection 384 is brought into contact with the first throttle projection 244. By the time the fourth projection 384 is brought into contact with the first throttle projection 244, engine warm-up is substantially completed, and the auxiliary throttle valve 341 is disposed substantially parallel to the main throttle valve 141.

Thereafter, when the vehicle begins to travel, the accelerator (not shown) is actuated. The actuation of the accelerator causes the accelerating lever 143 to move clockwise in pivotal motion about the main throttle valve spindle as shown in dash-and-dot lines. This movement of the accelerating lever 143 is transmitted to the auxiliary throttle lever 243 through the second connecting rod 252 to thereby cause the auxiliary throttle lever 243 to move in pivotal motion. This results in the third lever 383, which is maintained in contact with the auxiliary throttle lever 243 through the fourth projection 384 maintained in contact with the first throttle projection 244, moving in pivotal motion, so that the auxiliary throttle valve secured to the third lever 383 moves in pivotal motion in the same direction (counterclockwise) as the main throttle valve 141. As a result, the automotive vehicle is accelerated.

(4) When the Engine is Stopped

As soon as the engine stops, the pressure in the main outlet passage 112 rapidly rises and the negative pressure is replaced by atmospheric pressure. This causes the first lever 374 to move clockwise in pivotal motion to be restored to its original position.

Then, the bimetal strip 373 gradually contracts because the supply of heat thereto is cut off.

The second lever 376 is urged by the biasing action of the spring 381 to move clockwise in pivotal motion about the bimetal spindle 372, thereby returning the degree of opening of the auxiliary throttle valve 241 to the level shown in FIG. 1.

The invention has been shown and described hereinabove with reference to a carburetor assembly wherein the degree of opening of the auxiliary throttle valve 241 is controlled by means of the diaphragm device 361 and bimetal strip 373. It is to be understood, however, that the invention can achieve satisfactory results even if the system utilizing the diaphragm device 361 is eliminated. If this is the case, the operation of rapidly closing the auxiliary throttle valve 241 by utilizing the negative pressure at the outlet of the main carburetor 101 will not be performed, so that the movement of the auxiliary throttle valve 241 toward its closed position will become a slow process because it relies only on the action of the bimetal strip actuated by the heat produced by the warming-up of the engine. Thus, the closing of the auxiliary throttle valve 241 would take a relatively long period of time than in the embodiment utilizing the diaphragm device 361, and the air ratio would become such that the supply rate of the enriched fuel-air mixture would be increased.

Although the invention has been described as using the diaphragm device 361 and the bimetal strip 373, it is to be understood that the invention is not limited to the use of these specific mechanisms. More specifically, the bimetal strip may be replaced by any type of thermal motor, such as a wax type thermostat, which produces a displacement due to a rise in temperature.

Although the invention has been shown and described with reference to a carburetor assembly of the variable Venturi type, it is to be understood that the invention can achieve the same result when in corporated in a carburetor assembly of the fixed Venturi type.

I claim:

1. A carburetor assembly for an internal combustion engine having a main carburetor feeding a dilute fuel-air mixture to the engine and having an auxiliary carburetor feeding an enriched fuel air mixture to the engine with an auxiliary throttle valve, wherein the improvement comprises:

a diaphragm device disposed adjacent to the main carburetor and the auxiliary carburetor;

third means for transmitting a pressure of the dilute fuel-air mixture at an outlet of the main carburetor to said diaphragm device so as to cause one displacement of said diaphragm device;

a bimetal spindle;

a first lever one end of which is mounted pivotally on said bimetal spindle and the other end of which is connected to said diaphragm device;

a second lever one end of which is mounted pivotally on said bimetal spindle, said first lever and said second lever having projections for contacting each other by relative rotative motion around said bimetal spindle;

a third lever one end of which is secured to the auxiliary throttle valve;

a first rod for connecting both the other end of said second lever and the other end of said third lever;

a bimetal strip one end of which is secured to said second lever and the other end to said bimetal spindle so as to rotate said second lever in a counterclockwise direction by heating thereof; and means for heating said bimetal strip in response to an increasing heat in the engine warming up.

2. A carburetor assembly for an internal combustion engine having a main carburetor feeding a dilute fuel-air mixture to the engine with a main throttle valve and having an auxiliary carburetor feeding an enriched fuel-air mixture to the engine with an auxiliary throttle valve, wherein the improvement comprises:

a diaphragm device, disposed adjacent to the main carburetor and the auxiliary carburetor;

a vacuum pipe connecting said diaphragm device and an outlet of the dilute fuel-air mixture in the main carburetor;

a bimetal spindle secured to an engine body;

a first lever one end of which is mounted pivotally on said bimetal spindle and the other end of which is connected to said diaphragm device, said first lever having a first projection adjacent to said bimetal spindle;

a second lever one end of which is mountedpivotally on said bimetal spindle, said second lever having a second projection adjacent to said bimetal spindle so that the first projection is able to come into contact with the second projection;

a third lever one end of which is secured to an auxiliary throttle valve shaft;

a first rod connecting with the other end of said second lever and the other end of said third lever;

a bimetal strip one end of which is secured to said second lever and the other end to said bimetal spindle so as to move said second lever in pivotal motion in a counterclockwise direction by heating thereof; and means for heating said bimetal strip in response to an increasing heat in the engine warming up.

3. A carburetor assembly according to claim 2, wherein the improvement further comprises;

a third projection extending from said third lever adjacent to the auxiliary throttle valve shaft;

an auxiliary throttle lever one end of which is mounted rotatably on the auxiliary throttle valve shaft, said auxiliary throttle lever having a throttle projection at the one end, said third projection and the throttle projection being disposed so as to contact each other when said third lever turns to an extent to contacting with said auxiliary throttle lever by the transmission of the displacement of both said diaphragm device and said bimetal strip;

an accelerating lever one end of which is secured to a shaft of the main throttle valve shaft in the main carburetor; and a second rod connecting both the other end of said auxiliary throttle lever and the other end of said accelerating lever.

4. A carburetor assembly for an internal combustion engine having a main carburetor feeding a dilute fuel-air mixture to the engine and having an auxiliary carburetor feeding an enriched fuel-air mixture to the engine with an auxiliary throttle valve, wherein the improvement comprises:

a diaphragm device disposed adjacent to the main carburetor and the auxiliary carburetor;

means for transmitting a pressure of the dilute fuel-air mixture at an outlet of the main carburetor to said diaphragm device so as to cause a displacement of said diaphragm device;

a thermal motor for causing another displacement in response to an increasing heat in the engine warming up; and means for transmitting the displacements to the auxiliary throttle valve so as to make a closing thereof, said thermal motor displacement being directly transferred to said means for transmitting.

5. A carburetor assembly according to claim 4, wherein said thermal motor is a bimetal strip.

6. A carburetor assembly for an internal combustion engine having a main carburetor feeding a dilute fuel-air mixture to the engine with a main throttle valve and having an auxiliary carburetor feeding an enriched fuel-air mixture to the engine with an auxiliary throttle valve, wherein the improvement comprises:

a bimetal spindle secured to an engine body;

a second lever one end of which is mounted pivotally on said bimetal spindle;

a third lever one end of which is secured to a shaft of the auxiliary throttle valve;

a first rod connecting both the other end of said second lever and the other end of said third lever;

a bimetal strip one end of which is secured to said second lever and the other end to said bimetal spindle so as to move said second lever in pivotal motion in a counterclockwise direction by heating thereof; and means for heating said bimetal strip in repsonse to an increasing heat in the engine warming up.

7. A carburetor assembly according to claim 6, wherein the improvement further comprises;

a third projection extending from said third lever adjacent to the shaft of the auxiliary throttle valve;

an auxiliary throttle lever one end of which is mounted pivotally on the shaft of the auxiliary throttle valve, said auxiliary throttle lever having a throttle projection at the one end, said third projection and the throttle projection being disposed so as to contact each other when said third lever turns to an extent of contacting with said auxiliary throttle lever by the transmission of the displacement in said bimetal strip;

an accelerating lever one end of which is secured to a shaft of the main throttle valve; and a second rod connecting the other end of said auxiliary throttle lever and the other end of said accelerating lever.

8. In a carburetor assembly for internal combustion engines of the type having a main carburetor for supplying a lean air-fuel mixture to the engine, an auxiliary carburetor for supplying an air-fuel mixture to the engine which is rich relative to that supplied by said main carburetor, and first and second throttle valves mounted in said main and auxiliary carburetor respectively, the improvement comprising:

temperature responsive means for producing a closing movement of said second throttle in accordance with increases in the temperature of said engine;

negative pressure responsive means for producing a closing movement of said second throttle valve in accordance with negative pressures on a downstream side of said main throttle valve; and a mechanical linkage means interconnected directly between said second throttle valve, said temperature responsive means, and said negative pressure responsive means for effectuating the closing of said second throttle means by said negative pressure responsive means and by said temperature responsive means displaceably engaging said linkage means, said linkage means permitting said temperature responsive means to cause closing movement of said second throttle beyond that caused by said pressure responsive means and independent of said first throttle means as said engine warms up.

9. In a carburetor according to claim 8, the further improvement comprising:

said temperature responsive means being formed of a spirally wound bimetal strip connected at one end to a spindle; and said linkage means including a first lever connected at the first end to said spindle and displaceable by said pressure responsive means, and a second lever pivotally supported by said spindle at one end, secured to a second end of said bimetal strip at a point longitudinally spaced from its said one end so as to be displaceable by said bimetal strip, and interconnected from a second end thereof to said auxiliary throttle, said second lever being additionally displaceable by said first lever abuttingly engaging said second lever.

10. A carburetor assembly for an internal combustion engine comprising:

a main carburetor having a flow passage for supplying fuel-air mixtures of a low air-fuel ratio to the engine;

an auxiliary carburetor having a flow passage disposed in parallel relation with the flow passage of the main carburetor, fuel-air mixtures flowing through the flow passage of said auxiliary carburetor and supplied to the engine having an air-fuel ratio lower than the air-fuel ratio of the fuel-air mixtures flowing through the flow passage of the main carburetor;

a main throttle valve mounted in the flow passage of the main carburetor;

an auxiliary throttle valve mounted in the flow passage of the auxiliary carburetor;

means for operating said main throttle valve;

first means for operating said auxiliary throttle valve;

second means adapted to produce a first displacement in accordance with the negative pressure of the fuel-air mixture on the downstream side of the main throttle valve, said displacement being converted to a movement and transmitted to said first means to move said auxiliary throttle valve toward a closed position: and third means adapted to produce a second displacement in accordance with a rise in the temperature of the engine, said second displacement being converted to a movement and transmitted directly to said first means to move said auxiliary throttle valve further beyond the position reached by the auxiliary throttle valve due to the movement of said second means toward a closed position.

11. A carburetor assembly as claimed in claim 10, further comprising fourth means for operating said auxiliary throttle valve, said fourth means being mechanically coupled to said main throttle valve operating means and the movement of said fourth means being transmitted only through said first means to the auxiliary throttle valve.

12. A carburetor assembly as claimed in claim 11, further comprising a choke valve disposed on the upstream side of the stream of a fuel-air mixture in the flow passage of the main carburetor, and a linkage adapted to bring the choke valve to a position in which the degree of opening thereof is proportional to the degree of opening of the main throttle valve.

* * * * *